US006669440B2

(12) United States Patent
Tsai

(10) Patent No.: US 6,669,440 B2
(45) Date of Patent: Dec. 30, 2003

(54) DUAL-CHAMBER AIR PUMP

(76) Inventor: Lung-Po Tsai, 27F, No. 29-3, Sec. 2, Chung-Cheng E. Rd., Tan-Shui Chen, Taipei Hsien (TW)

( * ) Notice: Subject to any disclaimer, the term of this patent is extended or adjusted under 35 U.S.C. 154(b) by 58 days.

(21) Appl. No.: 10/077,843

(22) Filed: Feb. 20, 2002

(65) Prior Publication Data

US 2003/0156941 A1 Aug. 21, 2003

(51) Int. Cl.[7] ..... F04D 29/46
(52) U.S. Cl. ..... 415/148; 417/234
(58) Field of Search ..... 415/148; 417/234, 417/264, 312, 313, 423.9; 251/65

(56) References Cited

U.S. PATENT DOCUMENTS 6,158,713 A * 12/2000 Ohya et al. ..... 251/65

* cited by examiner

*Primary Examiner*—Edward K. Look
*Assistant Examiner*—Dwayne J. White
(74) *Attorney, Agent, or Firm*—Rosenberg, Klein & Lee

(57) ABSTRACT

An air pump having a housing with a blower therein and an outlet and a control box. The control box has two conduits respectively and oppositely defined in a side face of the box, and two magnetic valves movably received in the control box and each corresponding to one of the conduits so as to selectively seal the conduits. The magnetic valve comprises a coil with a hole defined in a side face of the coil, a plug which has one free end movably received in the hole, a spring compressibly mounted between the side face of the coil and the plug and a pad securely attached to the other free end of the plug to selectively seal the conduit.

1 Claim, 8 Drawing Sheets

DUAL-CHAMBER AIR PUMP

BACKGROUND OF THE INVENTION

1. Field of the Invention

The present invention relates to an air pump, and more particularly to an air pump having two chambers each with a plug movably received inside the chamber so as to selectively supply air outward.

2. Description of Related Art

In general, an air pump is used to supply air into an inflatable object. e.gs., an air bed, an air toy. When the air pump is connected to the object to be inflated, the operation of the blower inside the air pump ensures that air is smoothly pumped into the subject. Therefore, to a simple object which has only one air inlet and one air outlet, the air pump does fulfill the needs. However, when the subject has multiple different areas to be inflated, the user will have to move the pump around to fill in each of the areas, which is quite troublesome and labor ineffective.

To overcome the shortcomings, the present invention tends to provide an improved air pump having dual chambers to mitigate and obviate the aforementioned problems.

SUMMARY OF THE INVENTION

The primary objective of the present invention is to provide an improved air pump with two chambers each with a plug movably received in the chamber so as to selectively supply air out of the air pump to inflate an object.

In order to accomplish the foregoing objective, the air pump of the present invention has a control box having two outlets defined oppositely in a side face of the control box and two plugs each selectively movable to seal a corresponding one of the outlets to stop air from flowing out of the outlet. With such an arrangement, the user is able to control the movement of the two plugs to simultaneously supply air out of the outlets or to supply air out of one of the outlets as required.

Other objects, advantages and novel features of the invention will become more apparent from the following detailed description when taken in conjunction with the accompanying drawings.

DETAILED DESCRIPTION OF THE PREFERRED EMBODIMENT

Figure 1:
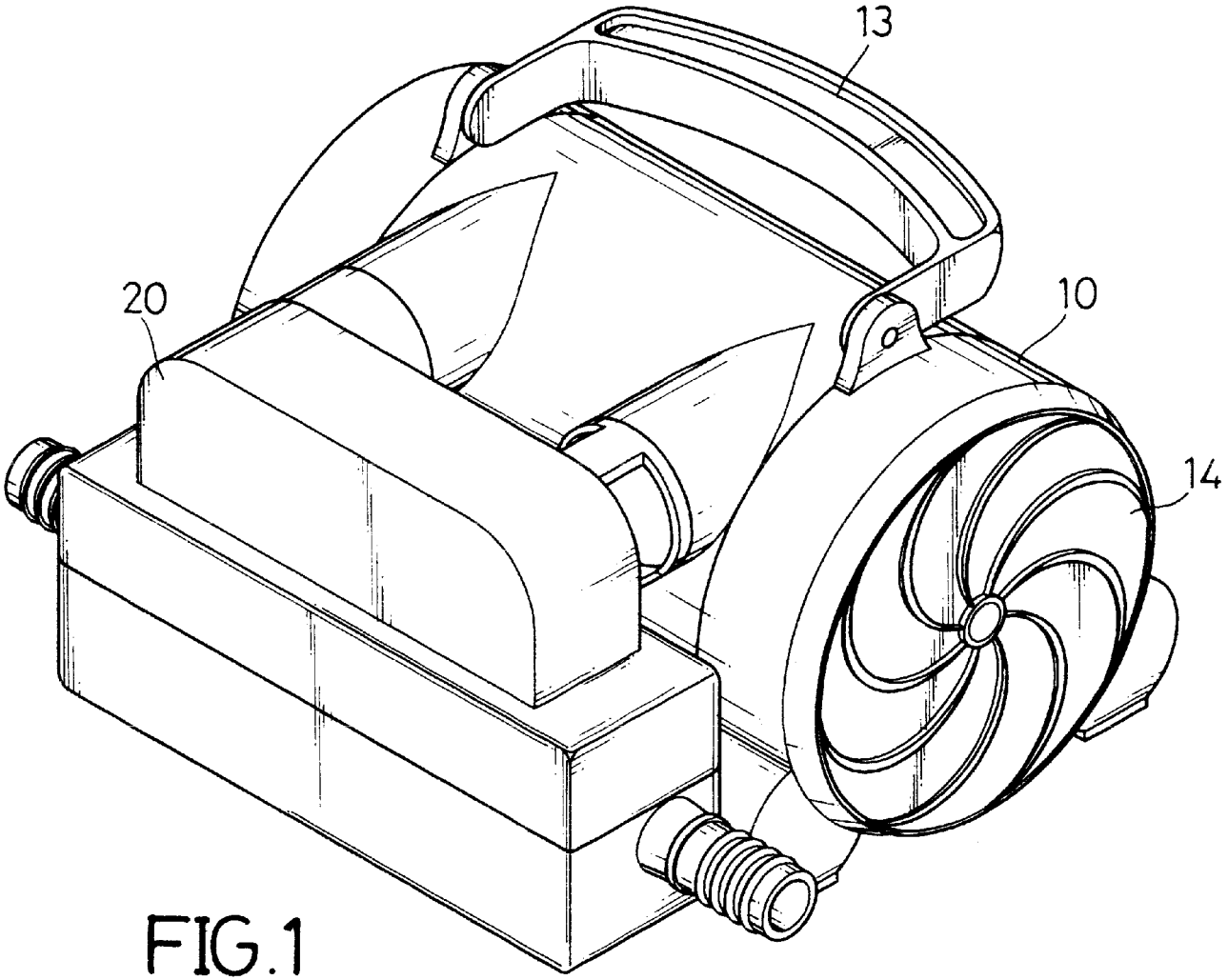
FIG. 1 is a perspective view of the air pump of the present invention.

With reference to FIG. 1, the air pump of the present invention has a housing (10) for receiving therein a blower (14) and a control box (20).

Figure 2:
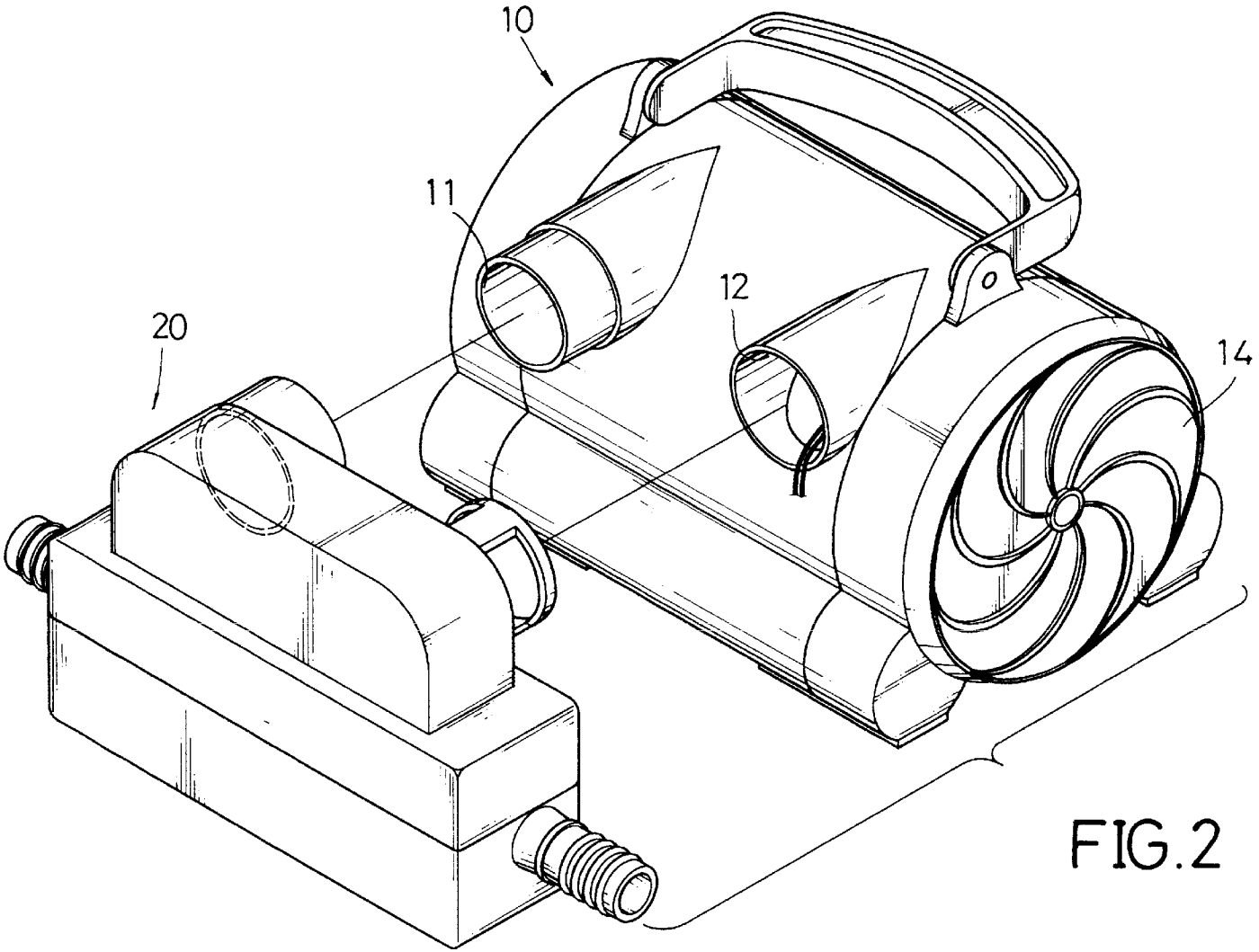
FIG. 2 is an exploded perspective view of the air pump shown in FIG. 1.

FIG. 2 shows that the housing (10) has an outlet (11), an inlet (12) and a handle (13) pivotally connected to a top of the housing (10) so as to enable a user to easily hold the air pump.

Figure 3:
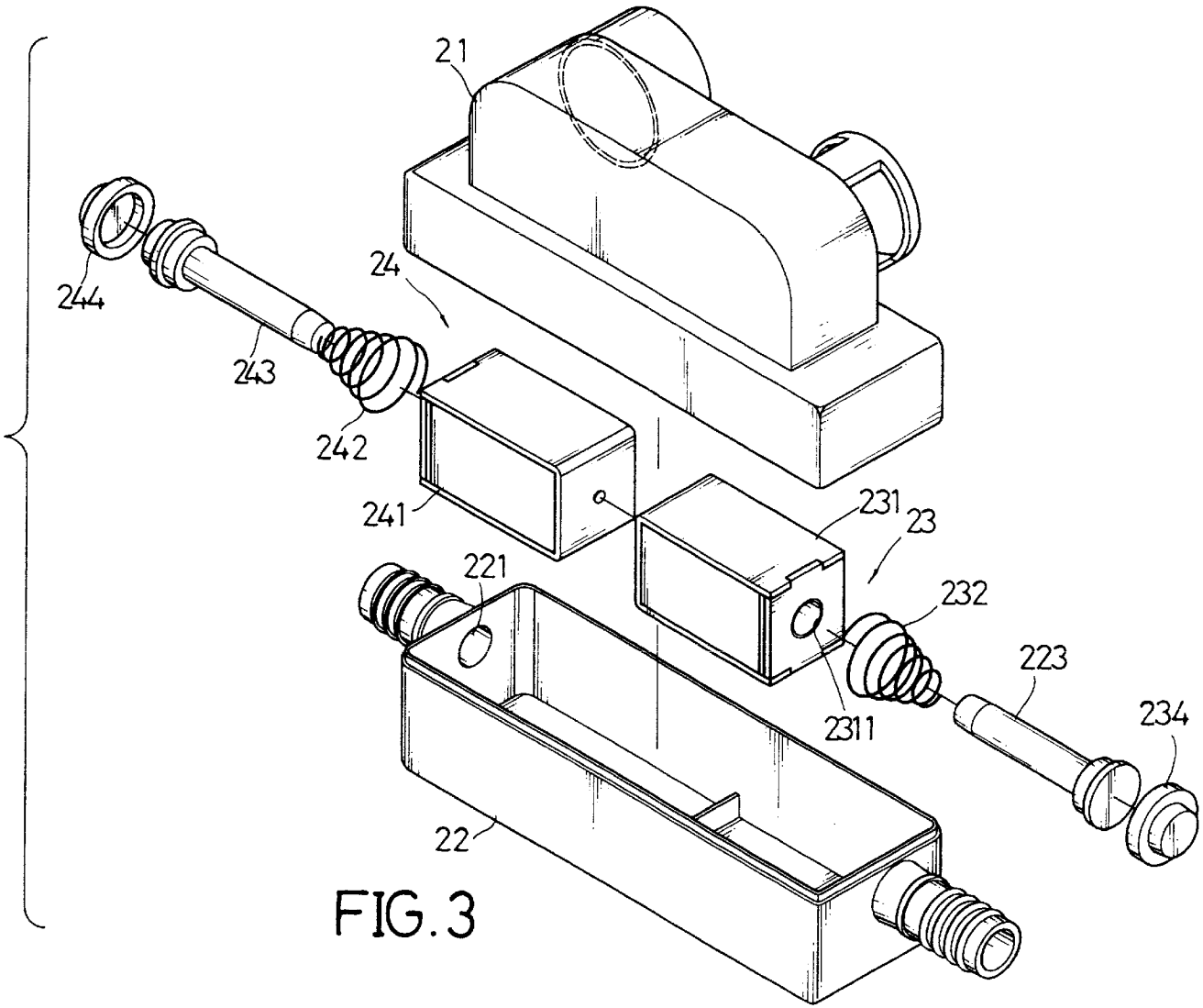
FIG. 3 is an exploded perspective view of the control box of the air pump of the present invention.
Figure 4:
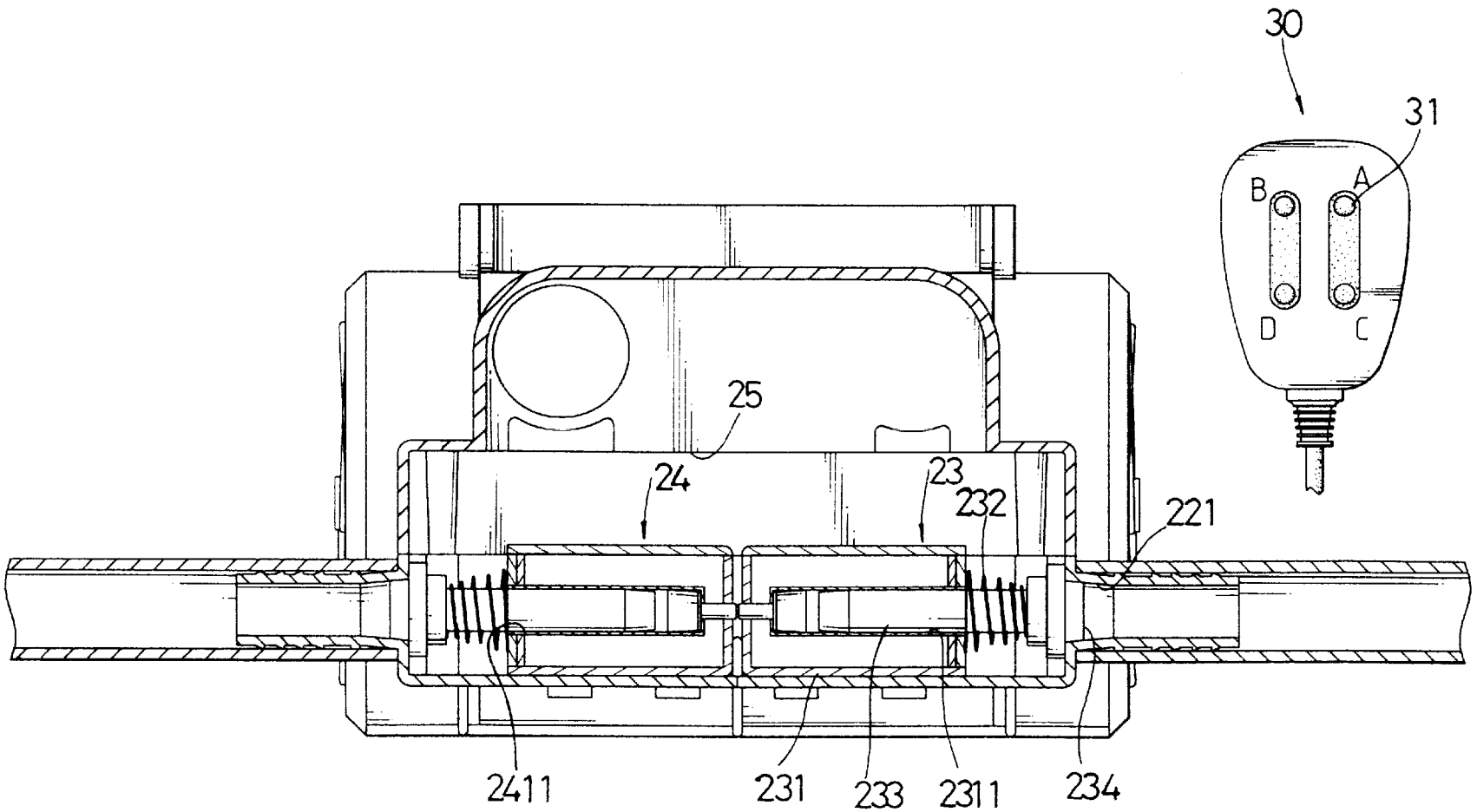
FIG. 4 is a cross sectional view showing the internal structure of the air pump of the invention.
Figure 5:
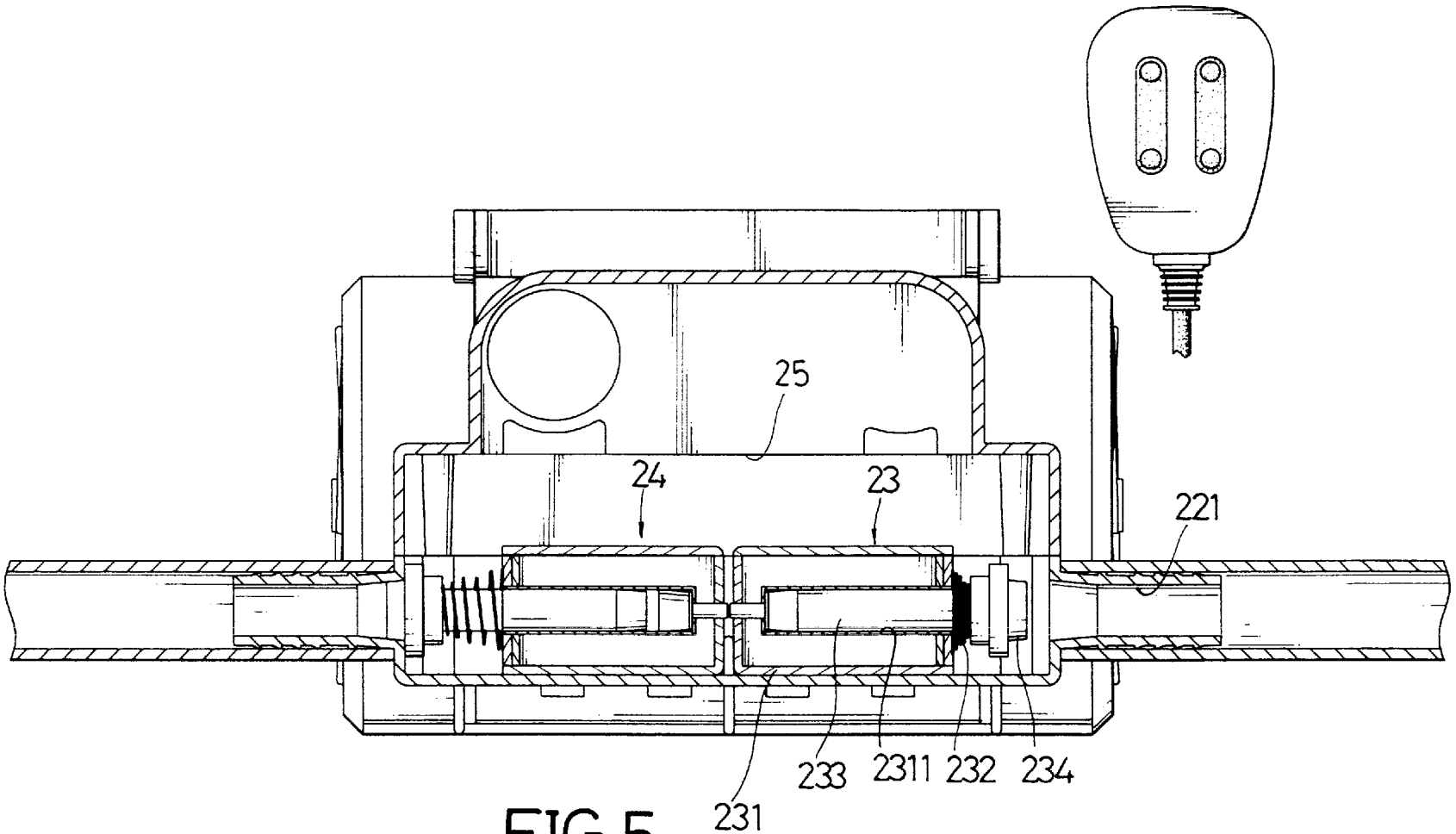
FIGS. 5 and 6 are cross sectional views showing the movement of either one of the plugs inside the control box.
Figure 6:
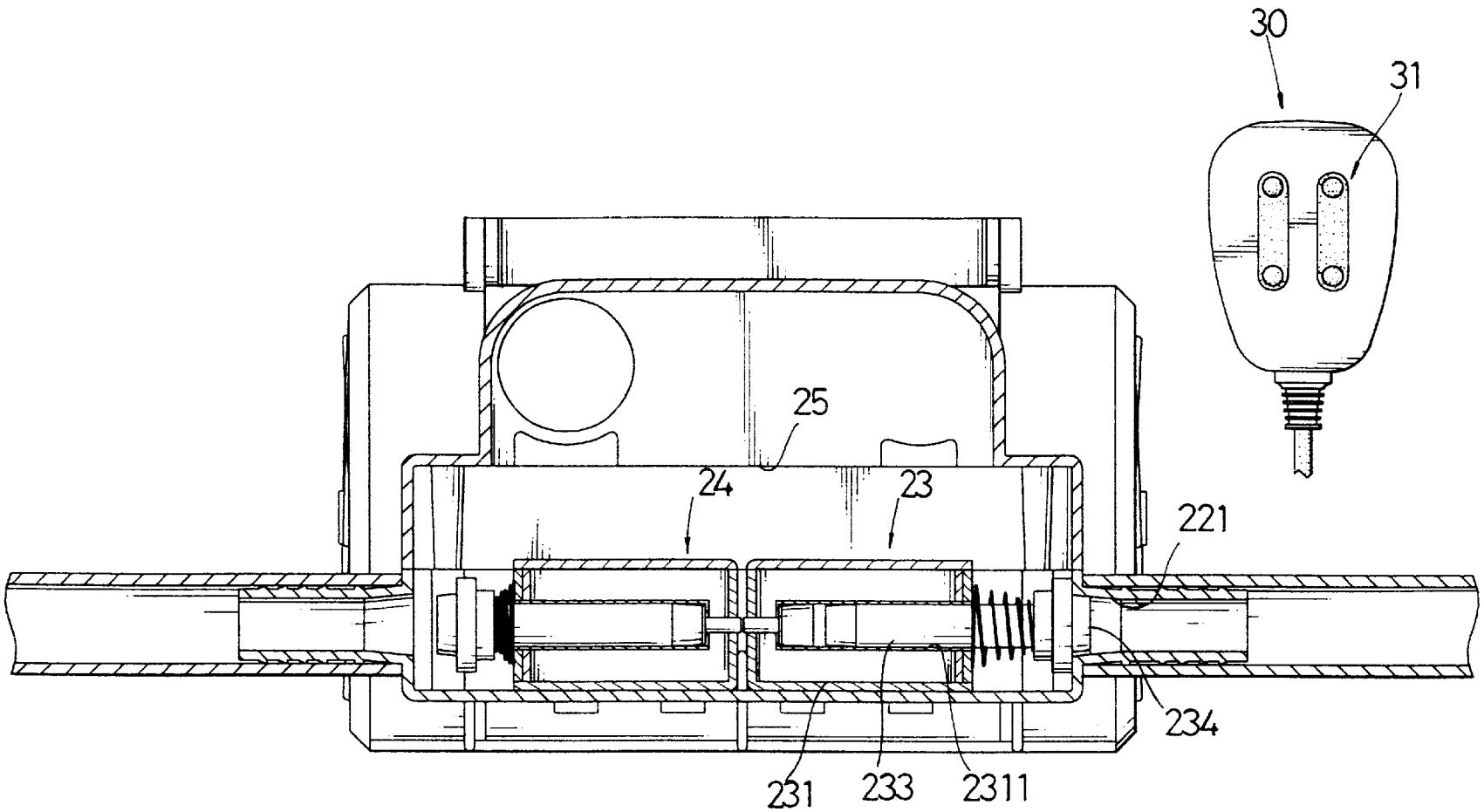
Figure 7:
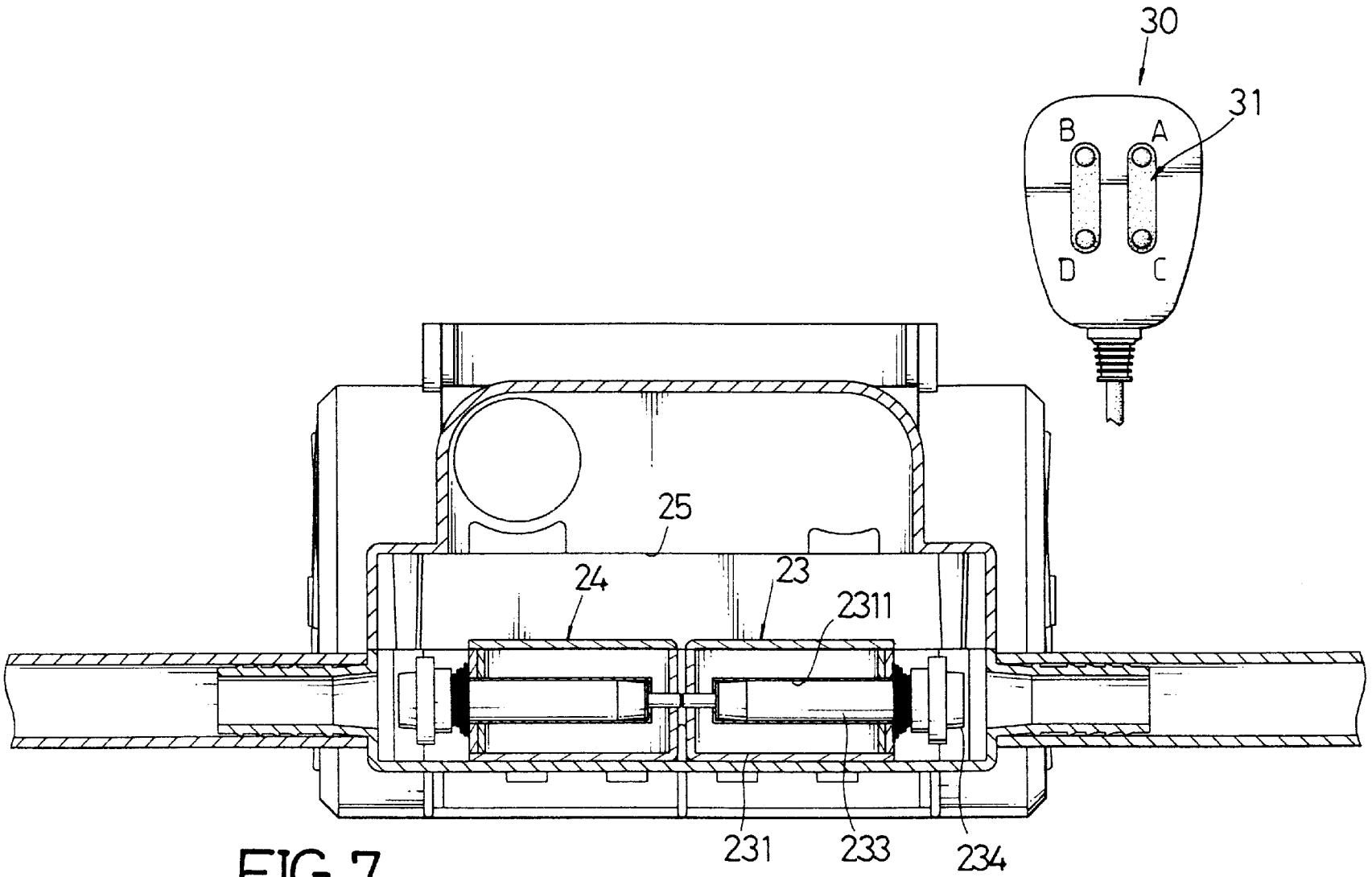
FIG. 7 is a cross sectional view showing the movement of both plugs inside the control box.
Figure 8:
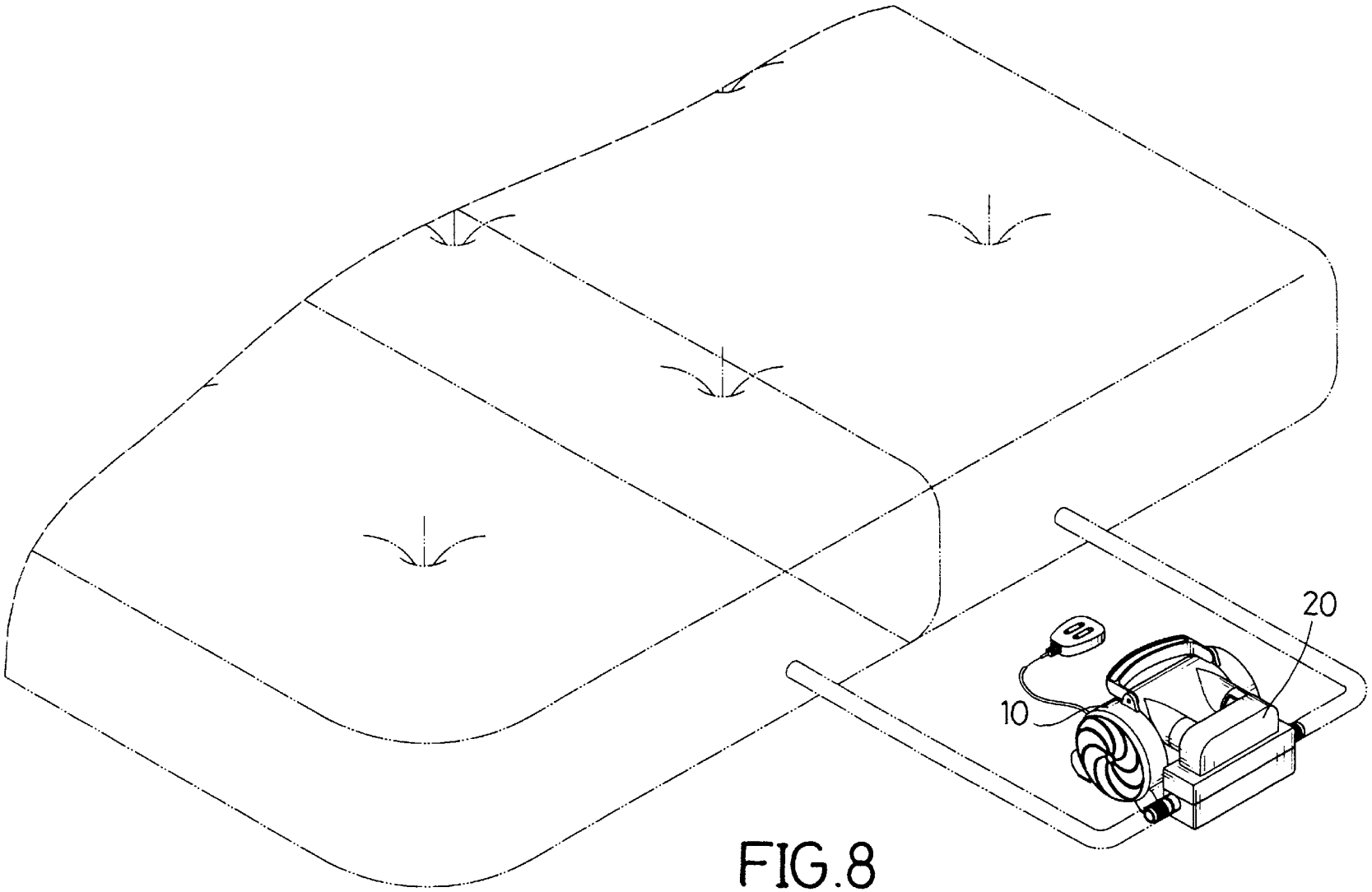
FIG. 8 is a schematic view showing the air pump of the present invention is used to simultaneously supply air to different areas of an object to be inflated.

With reference to FIG. 3, it is to be noted that the control box (20) has a top cover (21) and a bottom cover (22) together with the top cover (21) to define a space (25) (as shown in FIG. 4) therebetween to receive therein first and second magnetic valves (23,24). The bottom cover (22) further has two conduits (221) respectively formed on two opposite side faces to communicate with the outlet (11).

The first and second magnetic valves (23,24) are the same in structure, therefore, a description to the elements of the second magnetic valve (24) is omitted. However, after a description to the first magnetic valve (23) is completed, every feature the first magnetic valve (23) has, the second magnetic valve (24) automatically has.

The first magnetic valve (23) has a coil (231) with a hole (2311) defined in a side face of the coil (231), a spring (232), a plug (233) and a pad (234).

When the first and the second magnetic valves (23,24) are placed oppositely inside the space (25) relative to each other, with reference to FIGS. 3 and 4, the springs (232,242) are mounted on the plugs (233,243) and the plugs (233,243) are respectively inserted into the holes (2311,2411) so that the springs (232,242) are compressibly mounted between the coils (231,241) and the plugs (233,243). Thereafter the pads (234,244) are mounted on a free end of each of the plugs (233,243) and received in a corresponding one of the conduits (221) in the bottom cover (22) so as to stop the communication between the space (25) and the surrounding air due to the abutment of the springs (232,242) to the plugs (233,243). When the foregoing elements are assembled and the top cover (21) is securely engaged with the bottom cover (22), the first and second magnetic valves (23,24) are securely received in the space (25) and the pads (234,244) are respectively received in a corresponding one of the conduits (221). A controller (30) is provided to control the operation of the blower (14) inside the air pump, such that a user is able to use the buttons (31) on the controller (30) to simultaneously or respectively control the movement of the first and second magnetic valves (23,24). The buttons (31) are divided into A, B, C and D. The A and B buttons are used to control the blower and the two magnetic valves (23,24). The C and D buttons are used to control the two magnetic valves (23,24) only.

With reference to FIGS. 5, 6, 7 and 8, when the user presses button A or button B, the blower is activated to generate air flow to flow to the space (25). The plug (233,243) of the first or the second magnetic valve (23,24) is also moved due to the energization of the corresponding coil (231,241). That is, when the button A or B is pressed, a corresponding one of the coils is energized to have magnetic force, which attracts a corresponding one of the plugs (233,243) to move away from the corresponding conduits (221), such that the air flow generated by the operation of the blower is able to flow out of the air pump from the corresponding conduit (221). After the plug (233, 243) leaves the corresponding conduits (221), the air flow is able to inflate an object. In the meantime, the movement of the corresponding plug (233,243) deforms the corresponding spring (232,242) which provides the corresponding plug (233,243) a recoil force when the magnetic force is removed.

When the user presses both button A and button B, the blower is activated to generate air flow to flow to the space (25). The plugs (233,243) of the first and the second magnetic valves (23,24) are also moved due to the energization of the coils (231,241). That is, when the button A and B are pressed, both coils (231,241) are energized to have magnetic force, which attracts plugs (233,243) to move away from the conduits (221), such that the air flow generated by the operation of the blower is able to flow out of the air pump from both conduits (221). After the plugs (233,243) leave the conduits (221), the air flow is able to inflate an object to be inflated from two different conduits (221). In the meantime, the movement of the respective plugs (233,243) deforms the corresponding spring (232,242) which provides the corresponding plug (233,243) a recoil force when the magnetic force is removed.

However, when the user wants to deflate an object, the user only needs to press down the button C or D or both the buttons C and D to move the respective plug (233,243) or both the plugs (233,243) to leave the conduit(s). Then, due to the pressure difference between the subject and the space (25), air flow is generated and accordingly flows out of the object.

It is concluded that the air pump of the present invention has the following advantages:

Easy Operation

The user only needs to press the button(s) to control the movement of the plugs (233,243) so as to accomplish the purpose of inflating or deflating an object.

Dual Function

A simple press to the button(s) can trigger the inflation or deflation of the air pump, which saves a lot of trouble for the user.

Simple Structure

Using a control box to receive two plugs to respectively and selectively seal the conduits is simple in structure and effective in operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an air pump having a housing with a blower therein and an outlet and a control box, wherein the improvements comprise:

the control box having two conduits respectively and oppositely defined in a side face of the control box, two magnetic valves being movably received in the control box and each magnetic valve corresponding to one of the conduits so as to selectively seal the conduits, each of the magnetic valves including (a) a coil with a hole defined in a side face of the coil, (b) a plug having one of a pair of free ends movably received in the hole, (c) a spring compressibly mounted between the side face of the coil and the plug, and (d) a pad securely attached to the other free end of the plug to selectively seal a corresponding conduit, wherein each plug is attracted by a magnetic force generated by a corresponding energized coil to provide a respective conduit with communication between inside and outside of the control box.

* * * * *